US007252104B1

(12) United States Patent
Anderwald

(10) Patent No.: US 7,252,104 B1
(45) Date of Patent: Aug. 7, 2007

(54) WALKING CANE WITH INTEGRAL ITEM RETRIEVAL MEANS

(76) Inventor: Gabe R. Anderwald, 2896 FM 470, Bandera, TX (US) 78003

( * ) Notice: Subject to any disclaimer, the term of this patent is extended or adjusted under 35 U.S.C. 154(b) by 52 days.

(21) Appl. No.: 11/097,708

(22) Filed: Apr. 1, 2005

Related U.S. Application Data

(60) Provisional application No. 60/558,806, filed on Apr. 2, 2004.

(51) Int. Cl.
*A45B 3/00* (2006.01)

(52) U.S. Cl. ..... 135/65; 135/66; 135/70; 135/80

(58) Field of Classification Search ..... 135/65–66, 135/70, 78, 80, 84; 223/118–119; 294/24; 248/155, 188.9
See application file for complete search history.

(56) References Cited

U.S. PATENT DOCUMENTS

| | | | | |
|---|---|---|---|---|
| 2,346,038 | A * | 4/1944 | Mason | 294/19.1 |
| 5,176,160 | A * | 1/1993 | Osborn | 135/66 |
| 5,392,800 | A * | 2/1995 | Sergi | 135/65 |
| 5,433,234 | A * | 7/1995 | Lapere | 135/66 |
| 5,636,650 | A * | 6/1997 | Kroeze | 135/66 |
| 5,640,985 | A * | 6/1997 | Snyder et al. | 135/65 |
| 6,951,224 | B2 * | 10/2005 | Garrett | 135/66 |

* cited by examiner

*Primary Examiner*—Winnie Yip
(74) *Attorney, Agent, or Firm*—Kenneth L Tolar

(57) ABSTRACT

A walking cane having an integral item retrieval means includes an elongated hollow shaft having a J-shaped handle member at an upper end. A lever is slidably positioned immediately beneath the handle member that is operably connected to a pivotal claw on the lower end of the shaft. Lifting the lever pivots the claw against the lower end of the shaft to trap an object therebetween.

5 Claims, 1 Drawing Sheet

WALKING CANE WITH INTEGRAL ITEM RETRIEVAL MEANS

CROSS REFERENCE RO RELATED APPLICATIONS

This application is entitled to the benefit of provisional application No. 60/558,806 filed on Apr. 2, 2004.

BACKGROUND OF THE INVENTION

The present invention relates to a walking cane having an operable gripping claw thereon allowing a user to retrieve an object without bending or stooping.

DESCRIPTION OF THE PRIOR ART

Many people with various physical aliments are required to walk with the assistance of a cane. However, the aliment often prevents such persons from bending to retrieve an item resting on the floor or ground. The present invention satisfies this problem by providing a uniquely designed walking cane having a pivotal claw at a lower end that allows a user to easily retrieve an item without bending or stooping.

SUMMARY OF THE INVENTION

The present invention relates to a walking cane. The device comprises an elongated, substantially hollow shaft having an upper end and a lower end. At the lower end is a bumper member for minimizing the impact of the shaft with the ground. At the upper end is a substantially J-shaped handle member. Immediately beneath the handle member is a substantially C-shaped lever having an arm extending therefrom that is slidably received within a vertical slot on the shaft. A distal end of the arm extends into the shaft interior and includes an insert attached thereto. The insert slides within an elongated, vertically oriented channel coaxially received within the shaft.

Adjacent the lower end of the shaft is a pivotal claw having a gripping member at a distal end. An opposing end of the claw is attached to a lower end of a drive link. A spring interconnects an upper end of the drive link and the pivot point of the claw to normally bias the gripping member upwardly, away from the shaft. A cable extends from the upper end of the drive link to the lever. Accordingly, lifting the lever raises the drive link against the bias of the spring thereby pivoting the claw downwardly against the bumper member to secure an object therebetween. Releasing the lever returns the claw to its original, raised position.

It is therefore an object of the present invention to provide a walking cane that allows a user to easily retrieve items without bending or stooping.

It is another object of the present invention to provide a walking cane having an integral item retrieval means that is easy to operate.

It is yet another object of the present invention to provide a walking cane that eliminates some of the burdens associated with using a walking cane.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
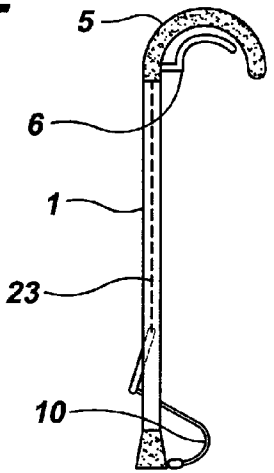
FIG. 2 is a plan view of the walking cane according to the present invention with the claw in a lowered position.
Figure 4:
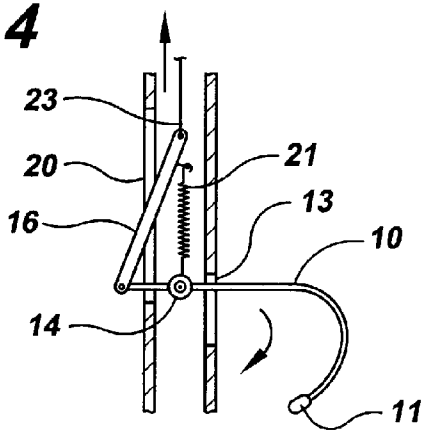
FIG. 4 is a detailed cross-sectional view of the claw and associated, spring-biased drive link.
Figure 1:
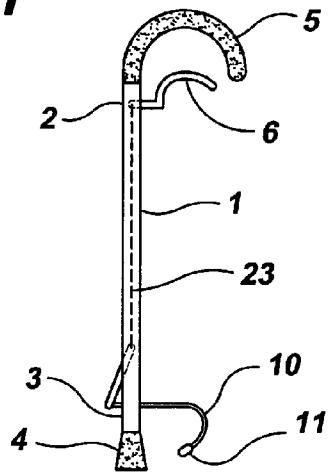
FIG. 1 is a plan view of the walking cane according to the present invention with the claw in a raised position.
Figure 3:
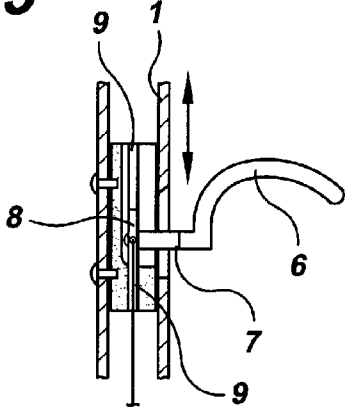
FIG. 3 is a detailed, cross-sectional view of the sliding lever assembly.

Referring now to FIGS. 1-4, the present invention relates to a walking cane. The device comprises an elongated substantially hollow shaft 1 having an upper end 2 and a lower end 3. At the lower end is a bumper member 4 for minimizing any impact of the shaft with the ground. At the upper end is a substantially J-shaped handle member 5. Immediately beneath the handle member is an arcuate, substantially C-shaped lever 6 having an arm 7 extending therefrom that is slidably received within a vertical slot on the shaft. The arm includes a distal end that extends into the shaft interior. An insert 8 is attached to the distal end of the arm that slides within a vertical channel 9 coaxially positioned within the shaft to smoothly guide the lever upwardly and downwardly.

Adjacent the lower end of the shaft is a pivotal claw 10 having a gripping member 11 at a lower end. The claw includes an intermediate portion that extends into the shaft via an opening 13. The intermediate portion is pivotally mounted within the shaft interior using a conventional fastener 14. An upper end of the claw extends through a slot 20 on an opposing portion of the shaft and is attached to a lower end of an elongated drive link 16. The intermediate and upper portions of the drive link extend into the shaft interior via slot 20.

A spring 21 interconnects the upper end of the drive link and the pivot point of the claw 14 to normally bias the gripping member upwardly, away from the shaft. A cable 23 interconnects the upper end of the drive link to the distal end of the lever. Accordingly, lifting the lever raises the link against the bias of the spring thereby pivoting the claw downwardly against the bumper member to secure an object therebetween. Releasing the lever returns the claw to its original, raised position.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A walking cane comprising:

an elongated, substantially hollow shaft having an upper end, a lower end and an interior;

a handle member positioned at the upper end of said shaft;

a pivotal claw positioned at the lower end of said shaft;

a slidable lever positioned immediately beneath said handle;

an arm extending from said lever and into the shaft interior, said arm having a distal end with an insert thereon, said insert sliding within a vertical channel coaxially positioned within the interior of the shaft to smoothly guide the lever upwardly and downwardly;

a spring-biased drive link having an upper end and a lower end, said lower end of said drive link pivotally attached to an upper end of said claw;

a cable having two opposing ends, one of said ends attached to said arm and another of said ends attached to the upper end of said drive link.

2. The walking cane according to claim 1 wherein said claw includes a lower end with a gripping member thereon.

3. The walking cane according to claim 2 wherein said spring-biased drive link includes a spring interconnecting the upper end of the drive link and a pivot point of said claw to bias the gripping member upwardly, away from the shaft.

4. The walking cane according to claim 3 further comprising a bumper member at the lower end of said shaft for minimizing any impact of the shaft with the ground.

5. The walking cane comprising:

an elongated, substantially hollow shaft having an upper end, a lower end and an interior;

a handle member positioned at the upper end of said shaft;

a pivotal claw positioned at the lower end of said shaft; said claw including an upper end, a lower end and intermediate portion, said intermediate portion extending into an opening on the shaft and pivotally mounted within the shaft interior, said upper end of the claw extending through a slot on a portion of the shaft opposite said opening;

an elongated drive link having a lower end, an upper end and an intermediate portion, said upper end of said claw attached to said lower end of said drive link, wherein the intermediate portion and upper end of said link extend through said slot into the interior of said shaft;

a slidable lever positioned immediately beneath said handle, said lever having a distal end;

a spring interconnecting the upper end of the drive link and the pivotal intermediate portion of the claw to bias the lower end of the claw upwardly, away from the shaft;

a cable interconnecting the upper end of the drive link to the distal end of the lever.

* * * * *